US008963795B1

(12) United States Patent
Wollschleger et al.

(10) Patent No.: US 8,963,795 B1
(45) Date of Patent: Feb. 24, 2015

(54) WEDGE SHAPED SCIMITAR ANTENNA

(71) Applicant: L-3 Communications Corp., New York, NY (US)

(72) Inventors: Steven D. Wollschleger, Salt Lake City, UT (US); Bryan J. Sillis, Salt Lake City, CA (US); Dennis F. Seegmiller, Salt Lake City, UT (US)

(73) Assignee: L-3 Communications Corp., New York, NY (US)

( * ) Notice: Subject to any disclaimer, the term of this patent is extended or adjusted under 35 U.S.C. 154(b) by 229 days.

(21) Appl. No.: 13/652,396

(22) Filed: Oct. 15, 2012

(51) Int. Cl.
*H01Q 7/00* (2006.01)

(52) U.S. Cl.
CPC ..... *H01Q 7/00* (2013.01)
USPC ..... 343/866; 343/895

(58) Field of Classification Search
CPC ..... H01Q 7/00; H01Q 1/36
USPC ..... 343/895, 702, 741, 743, 866, 870
See application file for complete search history.

(56) References Cited

U.S. PATENT DOCUMENTS

| | | | | |
|---|---|---|---|---|
| 3,015,101 | A | 12/1961 | Turner et al. | |
| 3,087,159 | A | 4/1963 | Gozinsky | |
| 3,366,963 | A | 1/1968 | Goff | |
| 3,613,104 | A * | 10/1971 | Bradshaw | 174/72 R |
| 4,691,209 | A | 9/1987 | Kershaw | |
| 6,437,756 | B1 * | 8/2002 | Schantz | 343/866 |
| 6,590,541 | B1 * | 7/2003 | Schultze | 343/741 |
| 6,876,334 | B2 * | 4/2005 | Song et al. | 343/767 |
| 7,106,258 | B2 | 9/2006 | Kuramoto | |
| 7,639,201 | B2 * | 12/2009 | Marklein et al. | 343/866 |
| 7,903,032 | B2 | 3/2011 | Ying et al. | |
| 8,130,163 | B2 | 3/2012 | Minard et al. | |

* cited by examiner

*Primary Examiner* — Hoanganh Le
(74) *Attorney, Agent, or Firm* — Kirton McConkie

(57) ABSTRACT

A wedge shaped scimitar radio frequency (RF) antenna can include a lip, an RF signal feed connected to the lip, a base, and a back surface. The antenna can also include a convexly curved outer surface that extends from the lip to the back surface. The convexly curved outer surface can be wedge shaped from the back surface of the antenna to the lip. The antenna can also include a concavely curved outer surface that extends from the lip to the base of the antenna, and the concavely curved outer surface can be wedge shaped from the base of the antenna to the lip.

24 Claims, 6 Drawing Sheets

WEDGE SHAPED SCIMITAR ANTENNA

BACKGROUND

A scimitar antenna is a curved radio frequency antenna having a profile comprising two diverging curves that originate from generally the same point (e.g., the signal feed point). As the name suggests, such antennas resemble a scimitar sword. Examples of scimitar antennas in the prior art include antennas disclosed in U.S. Pat. No. 3,015,101 to Turner et al., U.S. Pat. No. 3,087,159 to Gozinsky, and U.S. Pat. No. 3,366,963 to Goff. In some instances, such scimitar antennas have been able to provide radiation coverage that approximates hemispherical coverage. Such prior art scimitar antennas, however, have typically been able to operate over only a narrow bandwidth or within two separated narrow frequency bands. In some embodiments, the instant invention overcomes the foregoing problem and/or overcomes other problems and/or provides other advantages over prior art scimitar antennas.

SUMMARY

In some embodiments of the invention, a wedge shaped scimitar radio frequency antenna can include a lip, a radio frequency signal feed connected to said lip, a base, and a back surface. The antenna can also include a wedge shaped convexly curved outer surface that extends from the lip to the back surface. A first width of the convexly curved outer surface at the back surface can be greater than a second width of the convexly curved outer surface at the lip. The antenna can further include a wedge shaped concavely curved outer surface that extends from the lip to the base, and a first width of the concavely curved outer surface at the base can be greater than a second width of the concavely curved outer surface at the lip.

DETAILED DESCRIPTION OF EXEMPLARY EMBODIMENTS

Figure 1A:
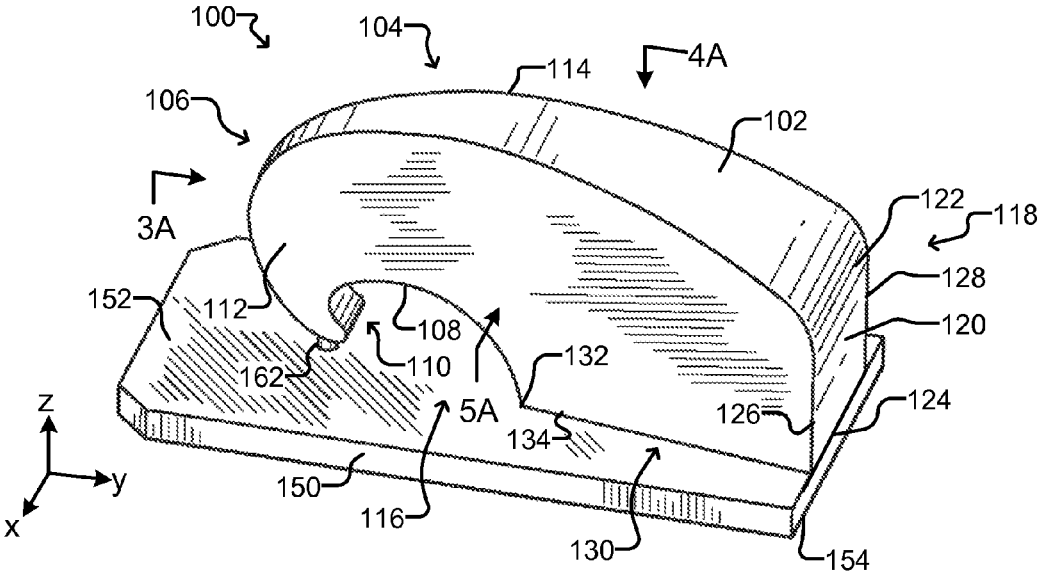
FIG. 1A is a side, perspective view of an example of a wedge shaped scimitar radio frequency antenna attached to a ground plate according to some embodiments of the invention.
Figure 1B:
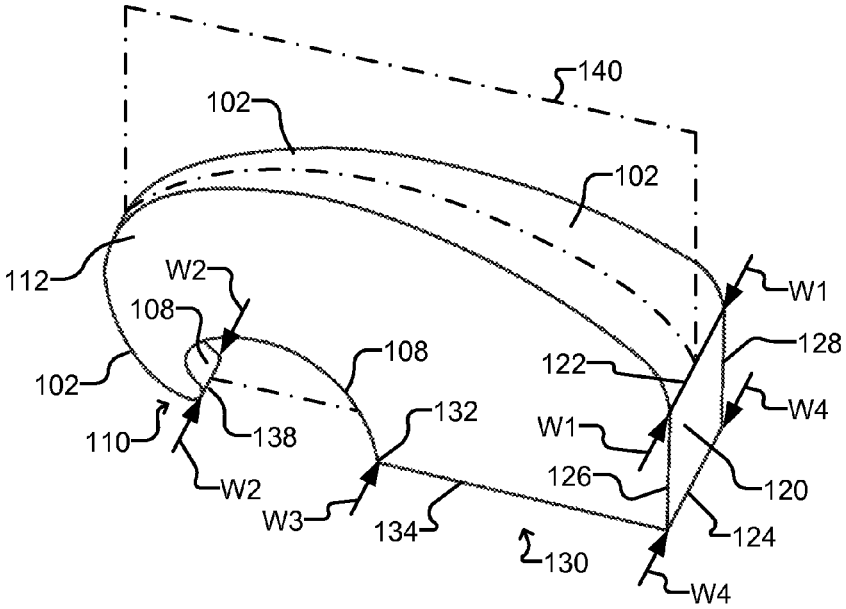
FIG. 1B shows the antenna in the view of FIG. 1A and illustrates examples of certain dimensions according to some embodiments of the invention.
Figure 2A:
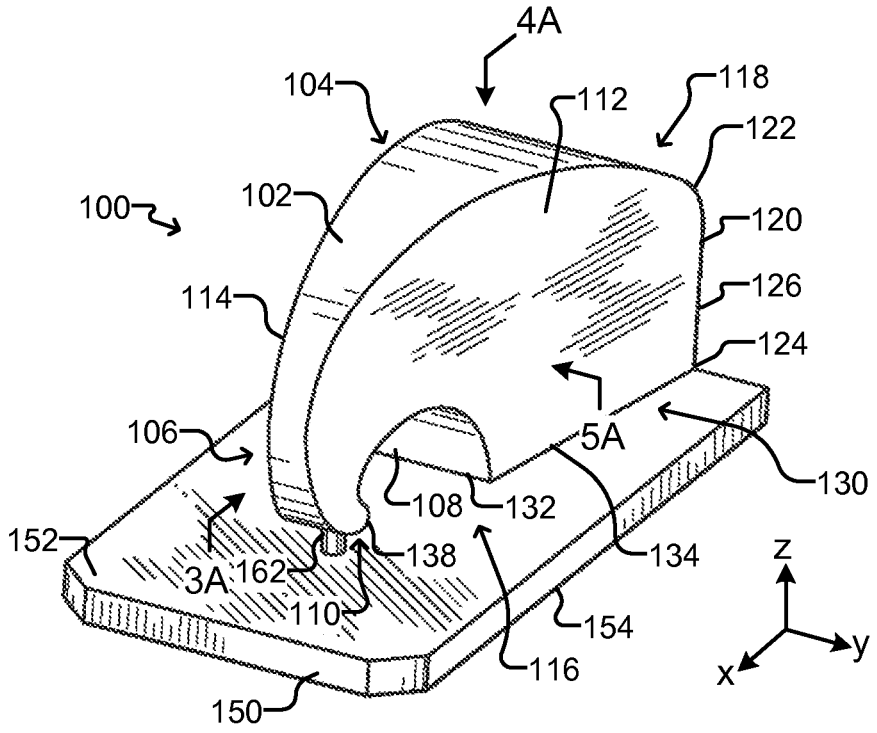
FIG. 2A is a front, perspective view of the antenna and ground plate of FIG. 1A.
Figure 2B:
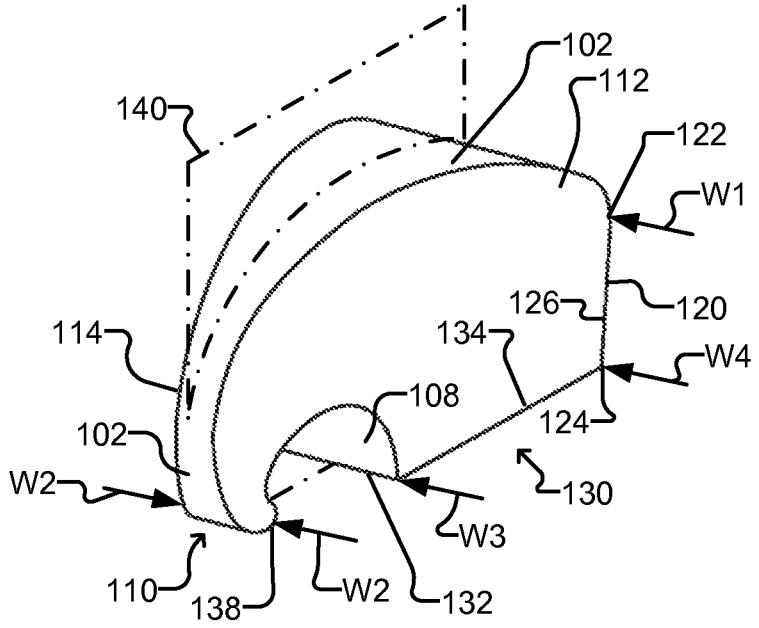
FIG. 2B shows the antenna in the view of FIG. 2A, highlighting the examples of the dimensions shown in FIG. 1B.

This specification describes exemplary embodiments and applications of the invention. The invention, however, is not limited to these exemplary embodiments and applications or to the manner in which the exemplary embodiments and applications operate or are described herein. Moreover, the Figures may show simplified or partial views, and the dimensions of elements in the Figures may be exaggerated or otherwise not in proportion for clarity. In addition, as the terms "on," "attached to," or "coupled to" are used herein, one object (e.g., a material, a layer, a substrate, etc.) can be "on," "attached to," or "coupled to" another object regardless of whether the one object is directly on, attached, or coupled to the other object or there are one or more intervening objects between the one object and the other object. Also, directions (e.g., above, below, top, bottom, side, up, down, under, over, upper, lower, horizontal, vertical, "x," "y," "z," etc.), if provided, are relative and provided solely by way of example and for ease of illustration and discussion and not by way of limitation. In addition, where reference is made to a list of elements (e.g., elements a, b, c), such reference is intended to include any one of the listed elements by itself, any combination of less than all of the listed elements, and/or a combination of all of the listed elements.

As used herein, "substantially" means sufficient to work for the intended purpose. When used herein with respect to a numerical value, "substantially" means within five percent. When used herein with respect to a direction or orientation (e.g., parallel, perpendicular, or the like), "substantially" means within five degrees of the stated direction or orientation.

The term "ones" means more than one.

As used herein to describe a surface of an object, "convexly curved" means that the surface curves outward away from the object, and "concavely curved" means that the surface curves inward into the object. Although "convexly curved" and "concavely curved" encompass spherical curves, neither term is limited to spherical curves.

Embodiments of the invention comprise a wedge shaped scimitar radio frequency (RF) antenna. The antenna can comprise a wedge shaped convexly curved surface and a wedge shaped concavely curved surface both of which originate from a common boundary but extend respectively to a back surface and a base of the antenna. In some embodiments, the wedge shaped scimitar antenna can be more compact and/or can operate in wider frequency bands than prior art scimitar antennas.

FIGS. 1A, 2A, 3A, 4A, and 5A illustrate various views of an example of a radio frequency (RF) antenna system that can comprise a wedge shaped scimitar RF antenna 100 coupled to a ground plate 130. FIGS. 1B, 2B, 3B, 4B, and 5B illustrates various views of the antenna 100, highlighting examples of certain dimensions of the antenna 100. With reference to FIGS. 1A through 5B, the example antenna 100 and ground plate 150 will now be described.

As shown, the antenna system of FIGS. 1A through 5B can comprise a radio frequency (RF) antenna 100 coupled to a ground plate 150. The antenna 100 can comprise an electrically conductive material such as aluminum, copper, or the like that is capable of radiating and receiving RF signals. The antenna 100 can comprise a solid block of material or can be a composite structure. The ground plate 150 can be a generally planar structure with opposing surfaces 152 and 154 (which can be planar), and the ground plate 150 can also comprise an electrically conductive material such as aluminum, copper, or the like. Although illustrated as generally rectangular in the Figures, the ground plate 150 can alternatively be other shapes such as circular, oval, square, or the like.

In some embodiments, the antenna 100 and ground plate 150 can be portions of a single, unitary structure. For example, the antenna 100 and ground plate 150 can be formed (e.g., machined) from a single piece of material and can thus be a unitary structure. In other embodiments, the antenna 100 and ground plate 150 can be distinct structures that are attached to each other. For example, the antenna 100 can be physically attached to the ground plate 150. Regardless, a base 130 of the antenna 100 can be electrically connected to the ground plate 150.

An RF signal feed 162 can be electrically connected to a lip 110 of the antenna 100. An electrical connector 160 (e.g., a coaxial cable connector) can provide an electrical connection to the RF signal feed 162. A cable or other electrical transmission medium (not shown) can be connected to the connector 160. An RF signal can thus be provided through the connector 160 and signal feed 52 to the antenna 100, which can radiate the RF signal into ambient space. Similarly, an RF signal in ambient space can be detected by the antenna 100 and provided through the signal feed 162 and connector 160 to the transmission medium (not shown) connected to the connector 160.

Figure 3A:
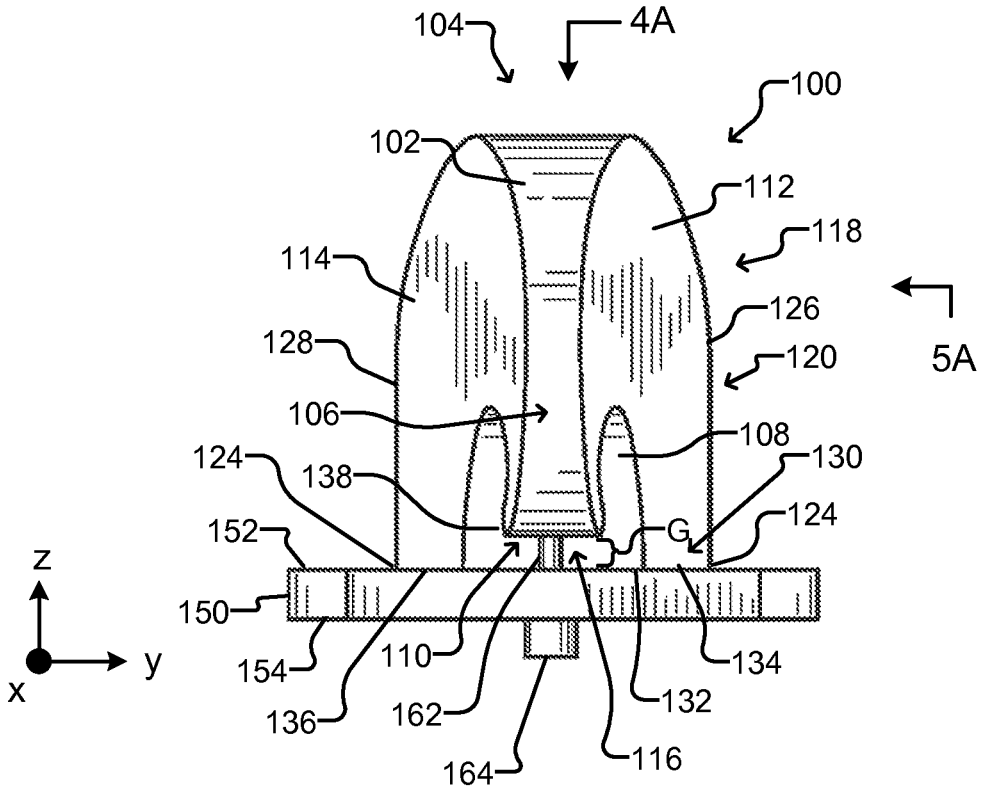
FIG. 3A is a front view of the antenna and ground plate of FIG. 1A.
Figure 3B:
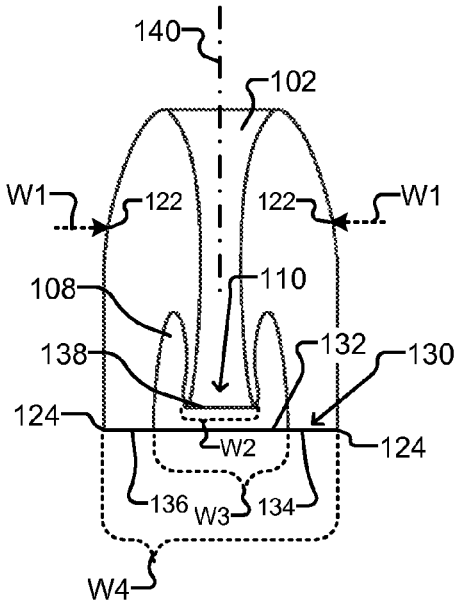
FIG. 3B shows the antenna in the view of FIG. 3A, highlighting the examples of the dimensions shown in FIG. 1B.
Figure 4A:
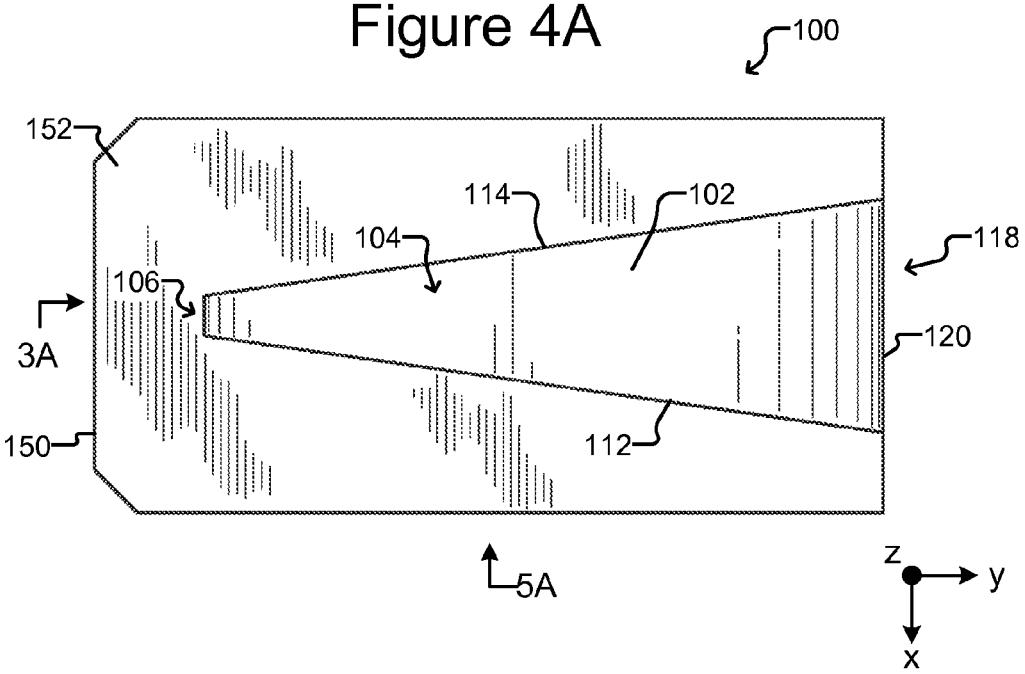
FIG. 4A is a top view of the antenna and ground plate of FIG. 1A.
Figure 4B:
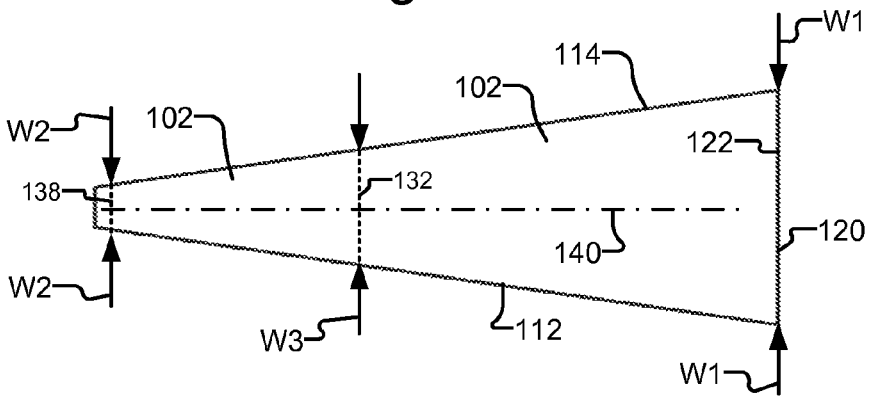
FIG. 4B shows the antenna in the view of FIG. 4A, highlighting the examples of the dimensions shown in FIG. 1B.

As shown in the FIG. 3A, there can be a gap G between the lip 110 of the antenna 100 and the upper surface 152 of the ground plate 1500. The size of the gap G can be adjusted to tune the antenna 100.

With continued reference to FIGS. 1A through 5B, a description of the antenna 100 will now be provided. As shown, the antenna 100 can comprise a base 130, a back surface 120, a wedge shaped convexly curved outer surface 102 (also referred to herein as the "upper curved surface 102"), a wedge shaped concavely curved outer surface 108 (also referred to herein as the "lower curved surface 108"), and opposing sides 112 and 114. The side 112 can be bounded by the upper curved surface 102, the lower curved surface 108, and side edges 134 and 126 of the base 130 and back surface 120, and the side 114 can be bounded by the upper curved surface 102, the lower curved surface 108, and side edges 136 and 128 of the base 130 and back surface 120. A top region 104 of the antenna 100 can thus comprise a first portion of the upper curved surface 102, and a bottom region 116 of the antenna 100 can comprise the lip 110, the lower curved surface 108, and the base 130. Similarly, a front region 106 of the antenna can comprise a second portion of the upper curved surface 102, and a back region 118 of the antenna can comprise the back surface 120. The top region 104 can have an overall wedge shape from the front region 106 to the back region 118, and the bottom region 116 can also have an overall wedge shape from the front region 106 to the back region 118.

The base 130 of the antenna 100 can comprise a generally planar surface bounded by a front edge 132, a back edge 124, and side edges 134 and 136 as shown. As also shown, the base 130 can be coupled to an upper surface 152 of the ground plate 150. As noted the antenna 100 and ground plate 150 can be a unitary structure, and in such a case, the base 130 is internal to the unitary structure. As also noted, the antenna 100 can alternatively be a distinct structure that is physically coupled at its base 130 to the upper surface 152 of the ground plate 150. In such a case, the base 130 is the surface of the antenna 100 coupled to the upper surface 152 of the ground plane 150. Regardless, the base 130, including front edge 132, back edge 124, and side edges 134 and 136, can be substantially parallel to the upper surface 152 of the ground plane 150.

The back surface 120 of the antenna 100 can also comprise a generally planar surface that is bounded by an upper edge 122, a lower edge (which as shown, can be the back edge 124 of the base 130), and side edges 126 and 128 as shown. As shown, the back surface 120 can extend away from the upper surface 152 of the ground plate 150. The back surface 120 is thus not parallel with the upper surface 152 of the ground plate 150 or the base 130. In some embodiments, the back surface 120 can be substantially perpendicular to the upper surface 152 of the ground plate 150 and the base 130.

The back surface 120 of the antenna 100 can truncate the upper curved surface 102 and thus the antenna 100. That is, given the trajectory of the curvature of the upper curved surface 102, the upper curved surface 102 would, if it extended past the back surface 120, intersect an imaginary plane (not shown) that is coplanar with the upper surface 152 of the ground plate 150 and the base 130. Because the upper curved surface 102 ends at the upper edge 122 of the back surface 120, however, the upper curved surface 102 and the antenna 100 are truncated at the back surface 120. This truncation can be customized to tune the operating frequency range of the antenna 100. For example, the truncation can primarily change (e.g., lower) the lower end of the operating frequency range of the antenna 100 without substantially affecting the upper end of the operating frequency range.

It is noted that the antenna 100 can be generally compact. For example, in some embodiments, the area of the upper surface 152 of the ground plate 150 can be twenty square inches or less, fifteen square inches or less, twelve square inches or less, or ten square inches or less, and the antenna 100 can be disposed entirely within the area of the upper surface 152 such that the antenna 100 does not extend beyond the boundaries of the upper surface 152 of the ground plate 150. In other embodiments, however, the upper surface 152 of the ground plate 150 can be larger than the foregoing examples.

As shown in the Figures, the antenna 100 can comprise a lip 110, and the upper curved surface 102 of the antenna 100 can extend from the lip 110 to the back surface 120 of the antenna 100. For example, as illustrated in FIGS. 1B, 2B, 3B, 4B, and 5B, the upper curved surface 102 of the antenna 100 can extend from a boundary 138 at the lip 110 to the upper edge 122 of the back surface 120. As noted, the back surface 120 can be substantially planar, and the upper edge 122 can be the uppermost extent of the back surface 120. As also shown, the upper curved surface 102 can be wedge shaped such that a width of the upper curved surface 102 generally narrows from the upper edge 122 of the back surface 120 to the boundary 138. For example, as illustrated in FIGS. 1A through 5B, the upper curved surface 102 can have a width W1 at the upper edge 122 that is wider than a width W2 of the upper curved surface 102 at the boundary 138 at the lip 110. For example, in some embodiments, the width W1 can be at least one and a half times the width W2. In other embodiments, the width W1 can be at least two, three, four, or five times the width W2. The foregoing numerical ranges, however, are examples only, and the width W1 can be less than one and a half times the width W2. It is noted that the widths W1 and W 2 are on the upper curved surface 102 from one side 112 of the antenna 100 to the other side 114 of the antenna. Moreover, the widths W1 and W2 can be substantially parallel to the boundary 138 and the upper edge 122 of the base 130.

Figure 6:
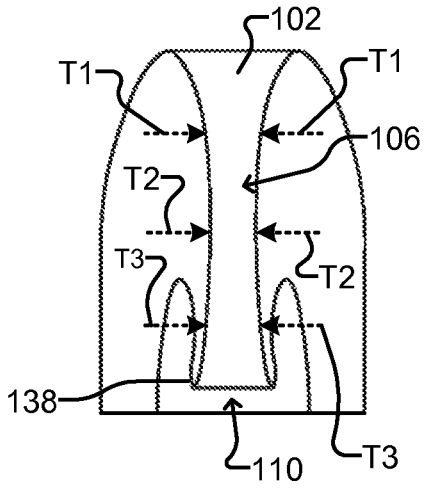
FIG. 6 shows the front view of the antenna as in FIG. 3B and illustrates an hour glass shape of a front portion of the antenna according to some embodiments of the invention.

The width of the upper curved surface 102 can have a generally uniform taper from the width W1 at the upper edge 122 to the boundary 138. As illustrated in and will be discussed below with respect to FIG. 6, however, the upper curved surface 102 can include an hour glass shaped portion (e.g., T1, T2, and T3 in FIG. 6) at the front region 106 of the antenna 100.

As also shown in the Figures, the lower curved surface 108 of the antenna 100 can extend from the lip 110 to the base 130 of the antenna 100. For example, as illustrated in FIGS. 1B, 2B, 3B, 4B, and 5B, the lower curved surface 108 of the antenna 100 can extend from the boundary 138 at the lip 110 to the front edge 132 of the base 130. As also shown, the lower curved surface 108 can be wedge shaped such that a width of the lower curved surface 108 generally narrows from the front edge 132 of the base 130 to the boundary 138. For example, as illustrated in FIGS. 1A through 5B, the lower curved surface 108 can have a width W3 at the front edge 132 of the base 130 that is wider than a width W2 of the lower curved surface 108 at the boundary 138 at the lip 110. For example, in some embodiments, the width W3 can be at least one and a half times the width W2. In other embodiments, the width W3 can be at least two, three, four, or five times the width W2. The foregoing numerical ranges, however, are examples only, and the width W3 can be less than one and a half times the width W2. Regardless, the width of the lower curved surface 108 can have a generally uniform taper from the width W3 at the front edge 132 to the boundary 138. It is noted that the widths W2 and W3 are on the lower curved surface 108 from one side 112 of the antenna 100 to the other side 114 of the antenna. Moreover, the widths W2 and W3 can be substantially parallel to the boundary 138 and the front edge 132 of the base 130.

The base 130 can also be wedge shaped. For example, the width W4 of the back edge (which corresponds to the bottom edge 124 of the back surface 120) of the base 130 can be wider than the width of the front edge 132 of the base 132. In some embodiments, the width W4 of the bottom edge 124 of the back surface 120 can be substantially the same as width W1 in the Figures. Regardless, the base 130 can taper from the bottom edge 124 to the front edge 132.

As described above, the upper curved surface 102 and the lower curved surface 108 can share a common boundary, namely, the boundary 138 at the lip 110. Moreover, the boundary 138 can be an imaginary line on the lip 110. The boundary 138, the upper edge 122 of the back surface 120, and the front edge 132 of the base 130 can be substantially parallel. In addition, the boundary 138, the upper edge 122 of the back surface 120, and the front edge 132 of the base 130 can be substantially parallel with the upper surface 152 of the ground plate 150.

Moreover, the upper curved surface 102 and the lower curved surface 108 can be oriented such that the upper curved surface 102 and the lower curved surface 108 are both everywhere substantially perpendicular to an imaginary plane 140 that passes through both the upper curved surface 102 and the lower curved surface 108 as generally illustrated in FIGS. 1B, 2B, 3B, 4B, and 5B. In some embodiments, the imaginary plane 140 can also be perpendicular to the boundary 138 at the lip 110, the upper edge 122 of the back surface 120, and/or the front edge 132 of the base 130. In some embodiments, the imaginary plane 140 can be perpendicular to the upper surface 152 of the ground plate 150 in addition to or rather than the boundary 138, the upper edge 122, and the front edge 132.

Figure 5A:
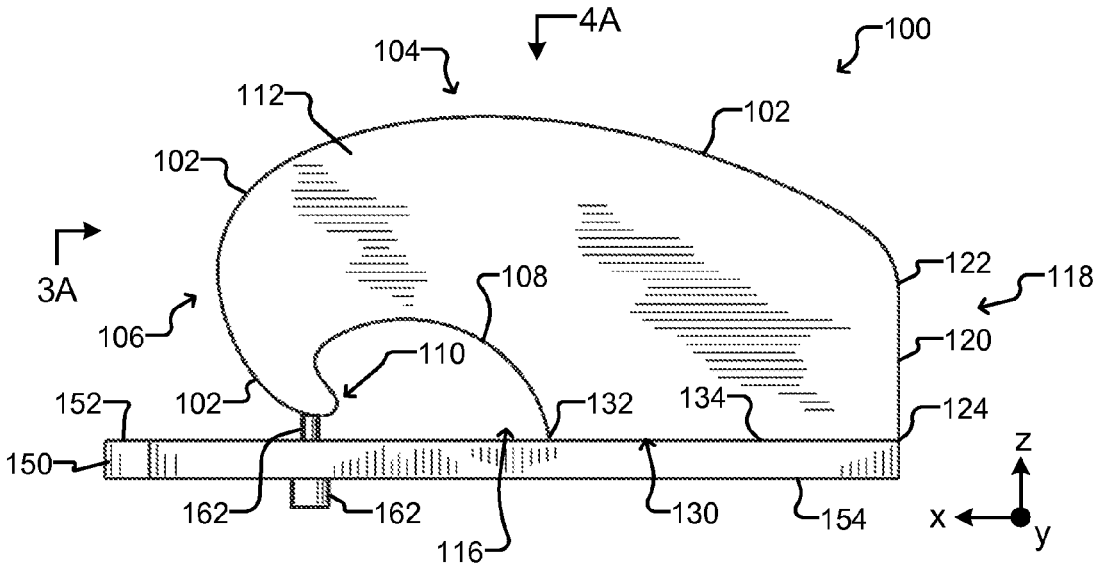
FIG. 5A is a side view of the antenna and ground plate of FIG. 1A.
Figure 5B:
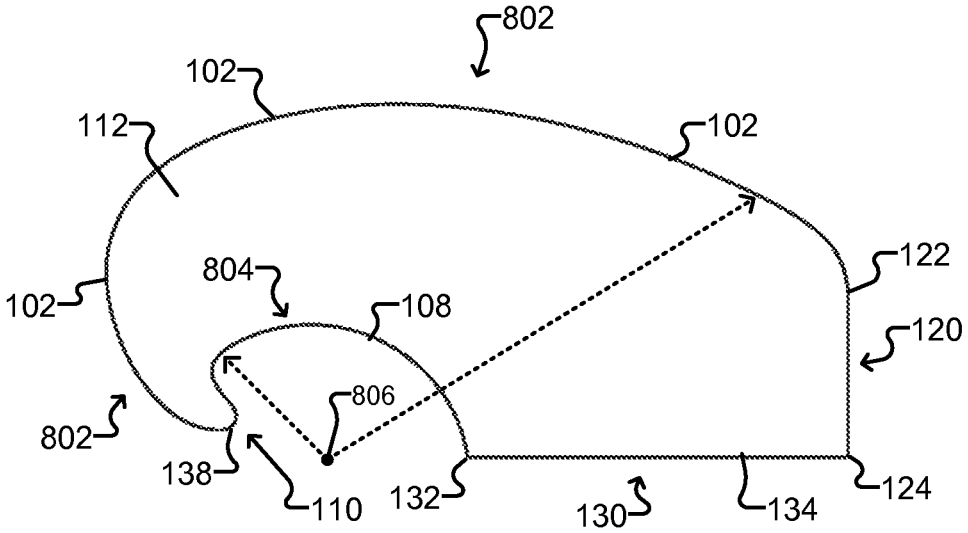
FIG. 5B shows the antenna in the view of FIG. 5A and illustrates certain features of the curvatures of a wedge shaped convexly curved outer surface and a wedge shaped concavely curved outer surface of the antenna according to some embodiments of the invention.

FIG. 5B illustrates examples of the curvature 802 of the upper curved surface 102 and the curvature 804 of the lower curved surface 108 as seen in a side view of the antenna 100 looking directly at the side 112 of the antenna 100. As shown, the upper curved surface 102 and the lower curved surface 108 of the antenna 100 can be described as having curvatures 802 and 804 that originate from a common start point, namely, the boundary 130 (which appears as a point in the side view of FIG. 5B), and diverge from each other. That is, the curvature 802 of the upper curved surface 102 originates from the same start point, namely, the boundary 130, as the curvature 804 of the lower curved surface 108, and then diverges from the curvature 804 of the lower curved surface 108.

In some embodiments of the invention, each curvature 802 and 804 can comprise a portion of a spiral curve. Thus, the curvature 802 can comprise a first spiral curve and the curvature 804 can comprise a second spiral curve. Both the first spiral curve and the second spiral curve can originate from the same start point (the boundary 138) and then diverge from each other to different end points, namely, the upper edge 122 (which appears as a point in the side view of FIG. 5B) of the back surface 120 in the case of the first spiral curve (corresponding to the curvature 802 of the upper curved surface 102) and the front edge 132 (which appears as a point in the side view of FIG. 5B) of the base 130 in the case of the second spiral curve (corresponding to the curvature 804 of the lower curved surface 108).

In some embodiments, the first spiral curve corresponding to the upper curved surface 102 can be a logarithmic spiral curve from a point 806 disposed between the boundary 138 and the front edge 132 of the base 130 as shown in FIG. 5B. Similarly, the second spiral curve corresponding to the lower curved surface 108 can be a logarithmic spiral curve from the point 806.

As mentioned above and illustrated in FIG. 6, the upper curved surface 102 can include an hour glass shape at the front region 106 of the antenna 100. For example, a portion of the upper curved surface 102 at the front region 106 of the antenna 100 can have an hour glass shape in which a width of the upper curved surface 102 is thinner at a middle T2 of the hour glass shape than at either end T1 and T3 of the hour glass shape. In some embodiments, such an hour glass shape can improve the radiating efficiency of the antenna 100 and expand the operational bandwidth of the antenna 100.

As noted, the gap G between the lip 110 of the antenna 100 and the upper surface 152 of the ground plane 150 can be adjusted to tune the antenna 100. In addition, the width W2 of the upper curved surface 102 and the lower curved surface 108 at the boundary 138 at the lip 110 of the antenna 100 can be sized to minimize impedance mismatches between the signal feed 160 and the antenna 100, which can thus also improve the operating efficiency of the antenna 100.

The wedge shapes of the upper curved surface 102 and the lower curved surface 108 can allow the antenna 100 to be more compact and provide a wider frequency response than prior art wide band antennas. For example, the upper curved surface 102 can be sized to correspond to the low cutoff frequency of the operating bandwidth of the antenna 100. Generally speaking, the longer the upper curved surface 102 is from the boundary 138 at the lip 110 to the upper edge 122 of the back surface 120 and/or the wider the width W1 at the upper edge 122 of the back surface 120, the smaller the low cutoff frequency of the operating bandwidth of the antenna 100. Similarly, the shorter the lower surface 102 is from the boundary 138 at the lip 110 to the front edge 132 of the base 130 and/or the thinner the width W3 at the front edge 132 of the base 130, the higher the high cutoff frequency of operating bandwidth of the antenna 100.

Some embodiments of the antenna 100 can be sized and configured to operate in the L-band (one to two gigahertz RF signals), S-band (two to four gigahertz RF signals), and/or C-band (four to eight gigahertz RF signals). For example, the antenna 100 can be sized such that the antenna fits entirely within the upper surface 152 of the ground plane 150, where the upper surface 152 is less than twelve square inches. So sized, the antenna 100 can provide widebeam coverage (e.g., substantially full hemispherical coverage) while operating in a bandwidth that includes the L-band, S-band, and/or C-band. Such substantially full hemispherical coverage can include no nulls at zenith and a minimum gain of negative three decibels (−3 dB) on the horizon. In some embodiments, the antenna 100 can maintain a two-to-one voltage standing wave ratio from one and a half gigahertz to six gigahertz. The foregoing numerical values are examples only. For example, the antenna 100 can be a different size and can operate within a different bandwidth than the size and bandwidth specified in the above examples.

The wedge shaped scimitar antenna 100 can be used in any application in which an RF antenna is used. For example, the antenna 100 can be mounted on a moving vehicle or aircraft. As another example, the antenna 100 can be part of a portable communications device carried by a person. For example, the antenna 100 can be configured to be mounted on a human operator's shoulder.

Although specific embodiments and applications of the invention have been described in this specification, these embodiments and applications are exemplary only, and many variations are possible.

We claim:

1. A wedge shaped scimitar radio frequency (RF) antenna comprising:

a lip an RF signal feed connected to said lip;

a base;

a back surface, a wedge shaped convexly curved outer surface that extends from said lip to said back surface, wherein a first width of said convexly curved outer surface at said back surface is greater than a second width of said convexly curved outer surface at said lip; and a wedge shaped concavely curved outer surface that extends from said lip to said base, wherein a first width of said concavely curved outer surface at said base is greater than a second width of said concavely curved outer surface at said lip.

2. The antenna of claim 1 further comprising a ground plate, wherein:

said base is coupled to a planar surface of said ground plate, and said signal feed extends from said planar surface of said ground plate directly to said lip.

3. The antenna of claim 2 further comprising a gap between said lip and said planar surface of said ground plate.

4. The antenna of claim 1, wherein said first width of said convexly curved outer surface is at least two times the second width of said convexly curved outer surface.

5. The antenna of claim 4, wherein said first width of said concavely curved outer surface is at least one and one half times the second width of said concavely curved outer surface.

6. The antenna of claim 1, wherein:

a top region of said antenna comprises a first portion of said convexly curved outer surface;

a front region of said antenna comprises a second portion of said convexly curved outer surface;

a bottom region of said antenna comprises said lip, said concavely curved outer surface, and said base; and a back region of said antenna comprises said back surface.

7. The antenna of claim 6, wherein:

said first portion of said convexly curved outer surface extends from said back surface to said second portion of said curved outer surface, and said second portion of said convexly curved outer surface extends from said first portion toward said lip.

8. The antenna of claim 6, wherein said top region has an overall wedge shape from said front region to said back region.

9. The antenna of claim 8, wherein said bottom region has an overall wedge shape from said front region to said back region.

10. The antenna of claim 1, wherein:

a curvature of said convexly curved outer surface from said lip to said back surface comprises a first spiral curve originating from said lip, a curvature of said concavely curved outer surface from said lip to said base comprises a second spiral curve originating from said lip, and said first spiral curve and second spiral curve diverge from each other.

11. The antenna of claim 10, wherein:

said first spiral curve is a substantially logarithmic spiral curve, and said second spiral curve is a substantially logarithmic spiral curve.

12. The antenna of claim 11, wherein said first spiral curve and said second spiral curve are logarithmically spiral from a same location that is directly between said lip and said base.

13. The antenna of claim 1, wherein a curvature of said convexly curved outer surface is truncated at said back surface.

14. The antenna of claim 13, wherein said back surface from said convexly curved outer surface to said base is substantially perpendicular to said base from said concavely curved outer surface to said back surface.

15. The antenna of claim 1, wherein a curvature of said convexly curved outer surface from said lip to said back surface is substantially a spiral curve truncated by said back surface.

16. The antenna of claim 1, wherein a trajectory of said convexly curved outer surface from said lip to said back surface is truncated by said back surface.

17. The antenna of claim 1, wherein said convexly curved outer surface and said concavely curved outer surface are substantially perpendicular to an imaginary plane passing through said convexly curved outer surface and said concavely curved outer surface.

18. A wedge shaped scimitar radio frequency (RF) antenna comprising:

a lip an RF signal feed connected to said lip;

a base;

a back surface, a wedge shaped convexly curved outer surface that extends from said lip to said back surface, wherein a first width of said convexly curved outer surface at said back surface is greater than a second width of said convexly curved outer surface at said lip; and a wedge shaped concavely curved outer surface that extends from said lip to said base, wherein a first width of said concavely curved outer surface at said base is greater than a second width of said concavely curved outer surface at said lip wherein:

said back surface comprises a top edge and a bottom edge, said base comprises a front edge and a back edge of said base is said bottom edge of said back surface, said convexly curved outer surface extends from said lip to said top edge of said back surface, and said concavely curved outer surface extends from said lip to said front edge of said base.

19. The antenna of claim 18, wherein said base is wider at said back edge than at said front edge.

20. The antenna of claim 19 further comprising a ground plate, wherein:

said base is coupled to a planar surface of said ground plate, and said signal feed extends from said surface of said ground plate directly to said lip.

21. The antenna of claim 20, wherein said back surface extends substantially perpendicular to planar surface of said ground plate.

22. The antenna of claim 21, wherein said convexly curved outer surface, said concavely curved outer surface, and said planar surface of said ground plate are substantially perpendicular to an imaginary plane passing through said convexly curved outer surface, said concavely curved outer surface, and said planar surface of said ground plate.

23. A wedge shaped scimitar radio frequency (RF) antenna comprising:

a lip an RF signal feed connected to said lip;

a base;

a back surface, a wedge shaped convexly curved outer surface that extends from said lip to said back surface, wherein a first width of said convexly curved outer surface at said back surface is greater than a second width of said convexly curved outer surface at said lip; and a wedge shaped concavely curved outer surface that extends from said lip to said base, wherein a first width of said concavely curved outer surface at said base is greater than a second width of said concavely curved outer surface at said lip, wherein a portion of said convexly curved outer surface has an hour glass shape.

24. A wedge shaped scimitar radio frequency (RF) antenna comprising:

a lip an RF signal feed connected to said lip;

a base;

a back surface, a wedge shaped convexly curved outer surface that extends from said lip to said back surface, wherein a first width of said convexly curved outer surface at said back surface is greater than a second width of said convexly curved outer surface at said lip; and a wedge shaped concavely curved outer surface that extends from said lip to said base, wherein a first width of said concavely curved outer surface at said base is greater than a second width of said concavely curved outer surface at said lip, wherein said convexly curved outer surface between said back surface and said lip comprises a section that is wider at opposite ends of said section than at a middle of said section.

* * * * *

UNITED STATES PATENT AND TRADEMARK OFFICE

CERTIFICATE OF CORRECTION

PATENT NO. : 8,963,795 B1
APPLICATION NO. : 13/652396
DATED : February 24, 2015
INVENTOR(S) : Steven D. Wollschleger, Bryan J. Willis and Dennis F. Seegmiller It is certified that error appears in the above-identified patent and that said Letters Patent is hereby corrected as shown below:

On the Title page

Item (72), the spelling of the last name of the second listed inventor is changed from "Sillis" to:

--Willis--

Item (72), the state of residence of the second listed inventor is changed from "CA" to:

--UT--

Signed and Sealed this
Eleventh Day of August, 2015

Michelle K. Lee

Michelle K. Lee
*Director of the United States Patent and Trademark Office*